US008556278B2

(12) United States Patent
Brittain

(10) Patent No.: US 8,556,278 B2
(45) Date of Patent: Oct. 15, 2013

(54) PACKAGING ASSEMBLY HAVING CASTERS

(75) Inventor: Jody S. Brittain, North Augusta, SC (US)

(73) Assignee: Georgia-Pacific Corrugated LLC, Atlanta, GA (US)

( * ) Notice: Subject to any disclaimer, the term of this patent is extended or adjusted under 35 U.S.C. 154(b) by 1063 days.

(21) Appl. No.: 12/168,525

(22) Filed: Jul. 7, 2008

(65) Prior Publication Data

US 2010/0001054 A1 Jan. 7, 2010

(51) Int. Cl.
*B62B 1/12* (2006.01)

(52) U.S. Cl.
USPC ..... 280/47.17; 280/47.26; 280/37; 280/652

(58) Field of Classification Search
USPC ..... 280/638, 639, 37, 40, 42, 651, 652, 280/47.131, 47.17, 47.19, 47.26, 47.34, 280/47.35, 63; 206/216, 223; 16/18 R, 45
See application file for complete search history.

(56) References Cited

U.S. PATENT DOCUMENTS 2,210,162 A * 8/1940 Boeye ..... 217/36
2,610,071 A * 9/1952 Davis et al. ..... 280/652
2,744,710 A * 5/1956 Gerosa ..... 248/129
3,087,740 A * 4/1963 Mitty et al. ..... 280/47.26
3,092,395 A * 6/1963 Mitty et al. ..... 280/652
3,279,811 A * 10/1966 Mitty et al. ..... 280/47.26
3,285,620 A * 11/1966 Mitty et al. ..... 280/47.26
3,423,101 A * 1/1969 Boeye ..... 280/46
3,462,171 A * 8/1969 Mitty et al. ..... 280/47.26
3,519,190 A 7/1970 Achermann et al.
3,606,372 A * 9/1971 Browning ..... 280/47.17
4,503,973 A * 3/1985 Andersson ..... 206/386
4,711,067 A 12/1987 Magni
5,092,615 A * 3/1992 Gregalis ..... 280/30
5,443,168 A * 8/1995 Dyment et al. ..... 211/149
5,934,041 A 8/1999 Rudolf et al.
6,098,378 A 8/2000 Wyatt
6,105,980 A * 8/2000 Cino et al. ..... 280/33.998
6,739,107 B1 5/2004 Lewis et al.
2005/0269791 A1 12/2005 Hoiriis et al.
2007/0074983 A1 4/2007 Oh

* cited by examiner

*Primary Examiner* — J. Allen Shriver, II
*Assistant Examiner* — Bridget Avery
(74) *Attorney, Agent, or Firm* — Crystal Jones

(57) ABSTRACT

Embodiments of Various packaging assemblies for moving a product in a carton are provided. In this regard, a representative packaging assembly, among others, includes a carton that is designed to contain the product, and a tray that is placed below the carton. The tray has at least one caster that facilitates moving the carton.

17 Claims, 15 Drawing Sheets

PACKAGING ASSEMBLY HAVING CASTERS

TECHNICAL FIELD

The present disclosure generally relates to a packaging assembly, and more particularly, a carton with casters for moving a packaged item, such as a mattress.

BACKGROUND

Packaged products, e.g., mattresses, can be difficult to move in and out of a distribution center because of their heavy weight and/or large size. Typically, large products use packaging assemblies that are usually moved using a dolly, forklift or other similar apparatus. Thus, there is a need in the industry to provide a packaging assembly that can be more easily moved.

SUMMARY

Embodiments of various packaging assemblies for moving a product in a carton are provided. In this regard, a representative packaging assembly, among others, includes a carton that is designed to contain the product, and a tray that is placed below the carton. The tray has at least one caster that facilitates moving the carton.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Disclosed are packaging assemblies for moving a product in a carton. The product may include retail products for indoor use (such as mattresses, appliances, and furnitures), retail consumables (such as diapers and charcoal), food/produce (such as fruits, potatoes, and candies), retail products for outdoor use (such as grills, patio/lawn furniture, and camping equipment, and business/factory items (such as pellets, stretch wraps, cooking oil, tubes and cores). In general, the product is any item that can be packaged in a carton.

Exemplary packaging assemblies are discussed with reference to the figures. Although the assemblies are described in detail, the assemblies are provided for purposes of illustration only and various modifications are feasible. The packaging assemblies shown in the figures have a cross-sectional shape of a square or rectangle; however, the packaging assemblies can have other cross-sectional shapes such as a circle, triangle, or other polygonal shapes.

Figure 1:
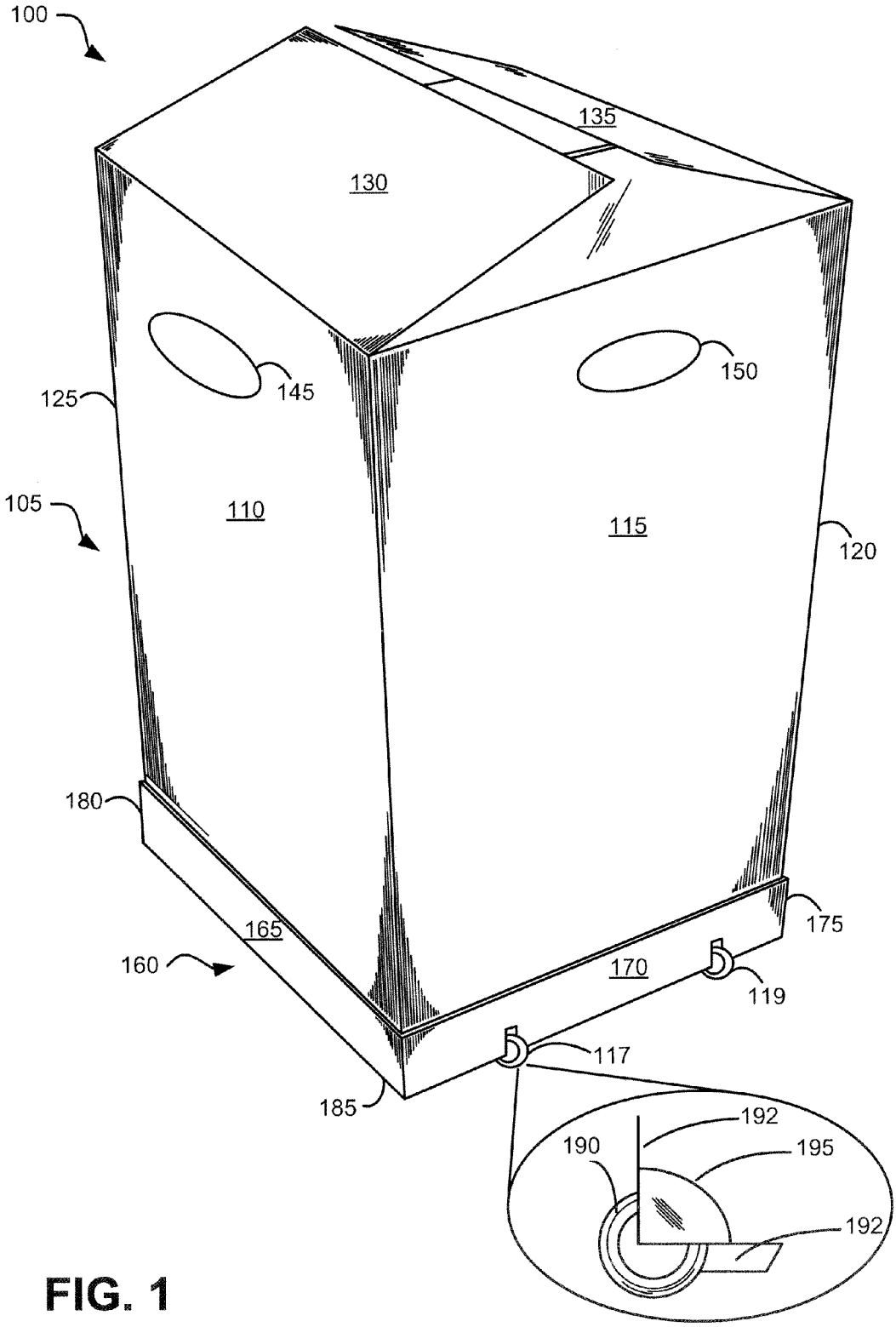
FIG. 1 is a perspective view of an embodiment of a packaging assembly with a tray that has at least one caster to facilitate moving the packaging assembly.

Referring now in more detail to the figures in which like reference numerals identify corresponding parts, FIG. 1 is a perspective view of an embodiment of a packaging assembly 100 with a tray 160 that has at least one caster 117, 119 to facilitate moving the packaging assembly 100. A packaging assembly 100 is designed to move a carton 105 that contains a product (not shown) using the tray 160 using the casters 117, 119.

The packaging assembly 100 includes the carton 105 and the tray 160 that is placed below the carton 105. The carton 105 includes side walls 110, 115, 120, 125, that include hand holes 145, 150. In this example, the hand holes 145, 150 are placed near the top edge of the side walls 110, 115. Although not shown, hand holes can also be placed on the side walls 120, 125. The carton 105 further includes top panels 130, 135 that are foldably attached to the top edge of the side walls 110, 120, respectively, and can open and close the carton 105. The carton 105 is further described in relation to FIGS. 2 and 5.

The tray 160 includes a bottom wall 185 and side walls 165, 170, 175, 180. The side wall 170 includes casters 117, 119 that are placed at the edge between the side wall 170 and the bottom wall 185. A user can use the hand holes 145, 150 to tilt and move the carton 105 on the casters 117, 119. The casters 117, 119 are spaced apart along the edge between the side wall 170 and the bottom wall 185 to provide balance to the package assembly 100 as the assembly 100 is moved. Alternatively or additionally, the carton 105 may not include hand holes 145, 150 on the side walls of the carton. A user can use the top edge of the carton 105 to tilt and move the carton 105 on the casters 117, 119.

In this example, the casters 117, 119 are recessed wheel casters that are designed to conceal at least a portion of a wheel 190 within the packaging assembly 100. The recessed wheel caster includes a wheel housing 195 that houses a portion of the wheel 190. The apex of the wheel housing 195 includes a pin mechanism that mechanically couples the wheel housing 195 to the wheel. The open ends of the wheel housing include extensions 192 that facilitate attaching the casters 117, 119 to the tray. The tray 160 is further described in relation to FIGS. 3 and 4.

Figure 2:
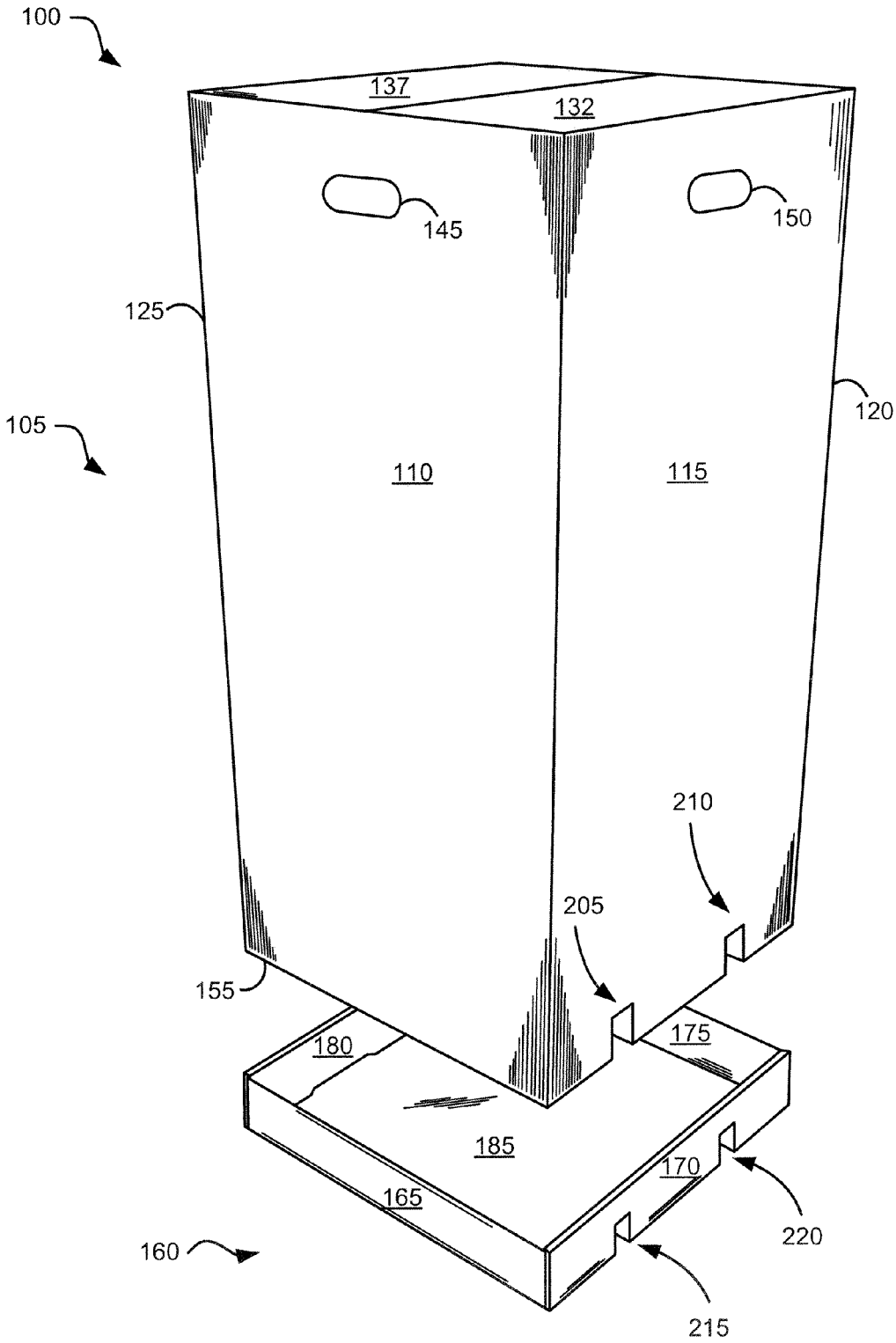
FIG. 2 is a perspective view of an embodiment of a preassembled packaging assembly, such as that shown in FIG. 1.

FIG. 2 is a perspective view of an embodiment of a preassembled packaging assembly 100, such as that shown in FIG. 1. The edges between the first side walls 115, 170 and bottom walls 155, 185 of the carton 105 and tray 160, respectively, include cut-outs 205, 210, 215, 220 that the recessed wheel casters 117, 119 (FIG. 1) register therethrough. In this example, the carton 105 further includes top panels 132, 137 that are foldably attached to side walls 115, 125, respectively, that are connected at the top edge of the side walls 115, 125 and can open and close the carton 105.

Figure 3:
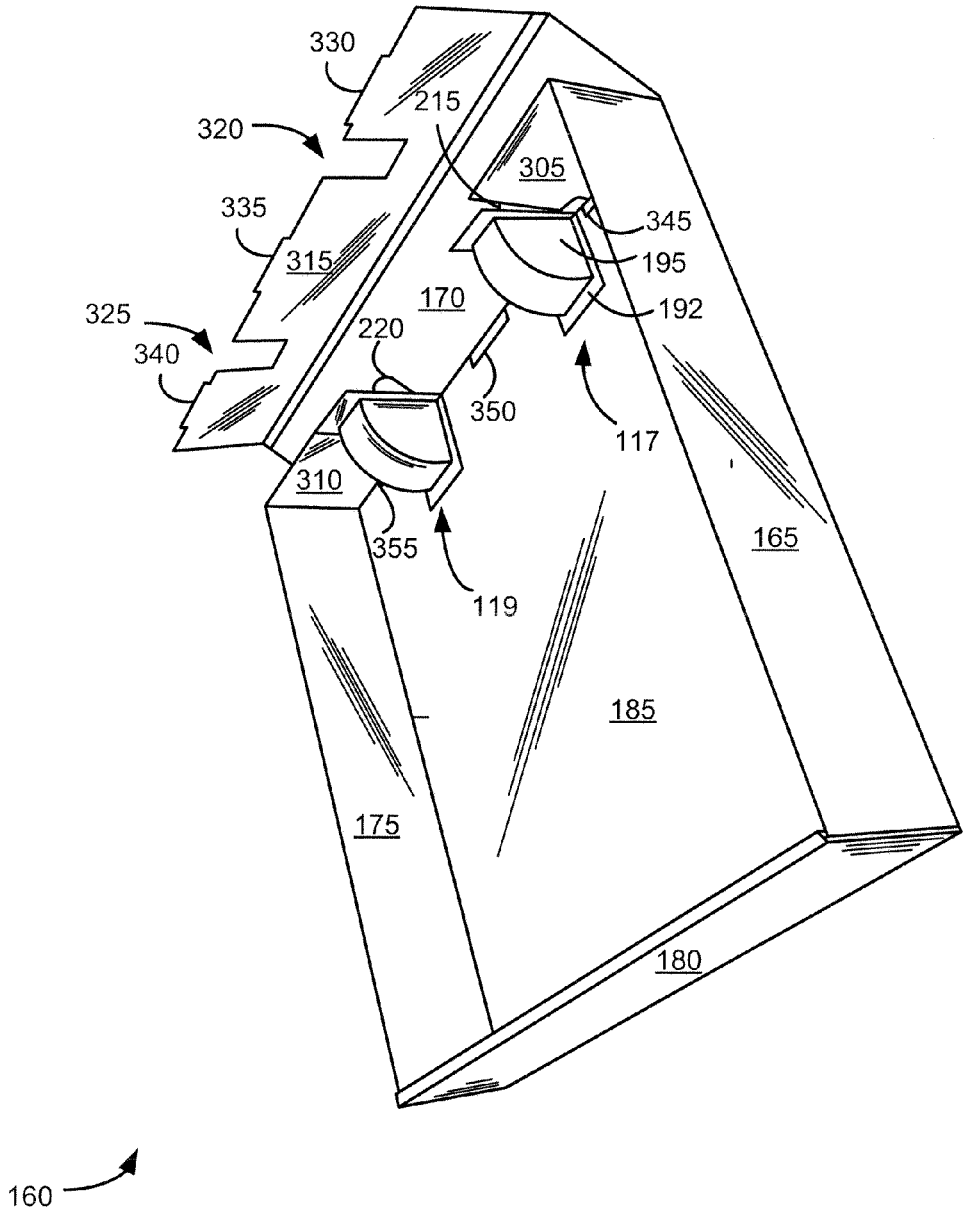
FIG. 3 is a perspective view of an embodiment of a tray, such as that shown in FIG. 1.

FIG. 3 is a perspective view of an embodiment of the tray 160, such as that shown in FIG. 1. The tray 160 includes a first side wall 170 that is foldably attached to a locking flap 315 that facilitates securing the casters 117, 119 at the edge between the first side wall 170 and the bottom wall 185. The bottom wall 185 includes slots 345, 350, 355 located adjacent to the edge between the first side wall 170 and the bottom wall 185. The side walls 165, 175 include respective end flaps 305, 310 that are captured between locking flap 315 and the first side wall 170 to erect the side walls 165, 175 in a desired position.

The locking flap 315 further includes locking tabs 330, 335, 340 that engage with the slots 345, 350, 355 of the bottom wall 185, respectively, and facilitate locking the locking flap 315 onto the bottom wall 185 to secure and support the casters 117, 119 between the locking flap 315 and the first side wall 170 and between the locking flap 315 and the bottom wall 185. The casters 117, 119 are placed between the slots 345, 350, 355 and registers through the cut-outs 215, 220, respectively. The locking flap 315 further includes cut-outs 320, 325 that are located between the locking tabs 330, 335, 340. The cut-outs 320, 325 engage the extensions 192 and the wheel housing 195 to facilitate capturing and maintaining the casters 117, 119 in a desired position.

Figure 4:
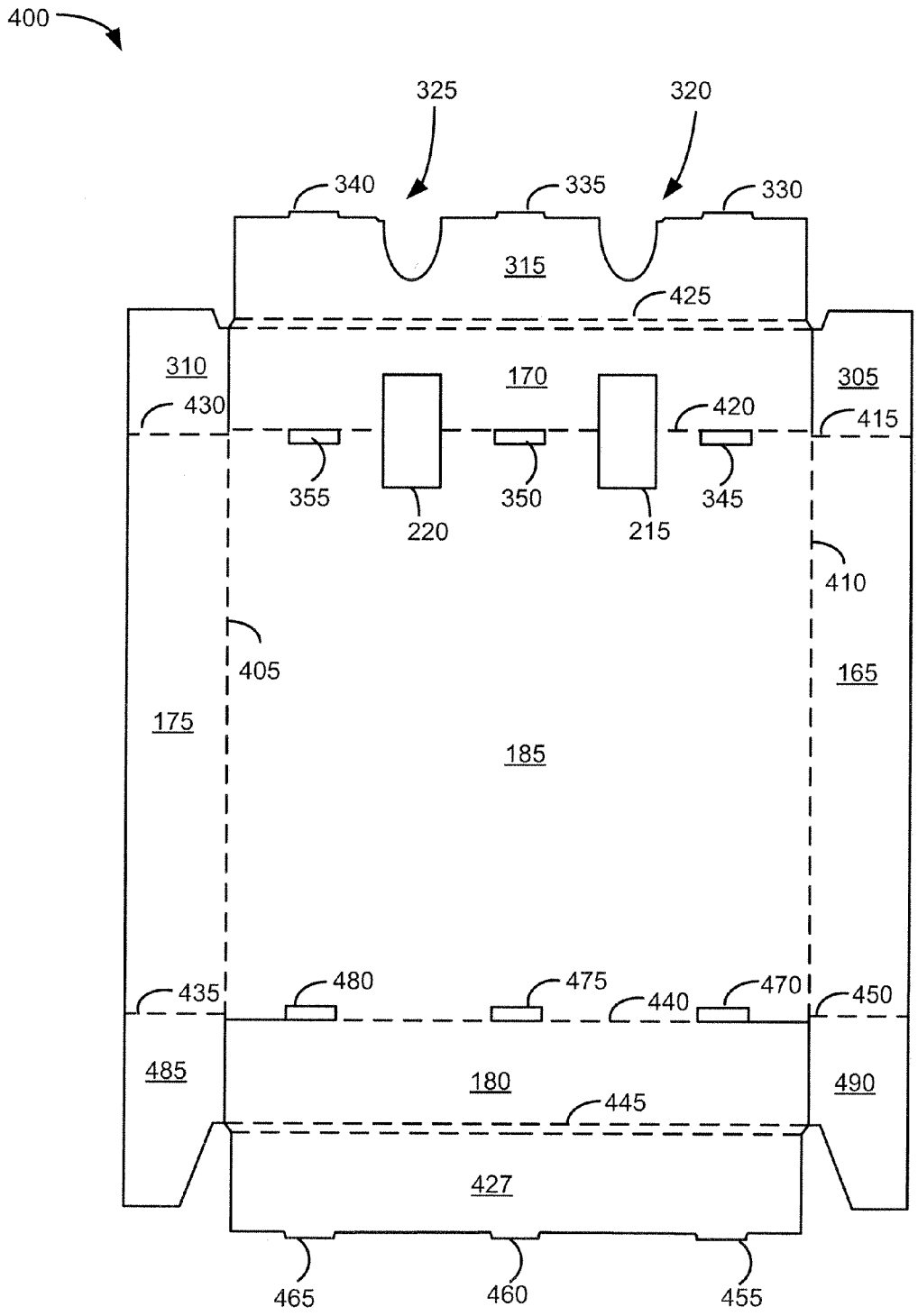
FIG. 4 is a plan view of an embodiment of a blank for erecting into a tray, such as that shown in FIG. 1.

FIG. 4 is a plan view of an embodiment of a blank 400 for erecting into the tray 160, such as that shown in FIG. 1. The blank 400 includes the bottom wall 185 and first, second, third and fourth side walls 170, 175, 180, 165, respectively. The second side wall 175 and bottom wall 185 are connected along their right sides to the left sides of the bottom wall 185 and fourth side wall 165 along first and second vertical fold lines 405, 410, respectively.

Top end flap 305, first side wall 170, top locking flap 315, and top end flap 310 extend above the fourth side wall 165, bottom wall 185, first side wall 170, and second side wall 175, and above horizontal fold lines 415, 420, 425, 430, respectively. Bottom end flap 485, third side wall 180, bottom locking flap 427, and bottom end flap 490 extend below the second side wall 175, bottom wall 185, third side wall 180, and fourth side wall 165, and below horizontal fold lines 435, 440, 445, 450, respectively. The top end flaps 305, 310 are generally in the shape of a rectangle and have a height that is approximately the height of the first side wall 170. The bottom end flaps 485, 490 are generally in the shape of a rhombus and have a height that is approximately the height of both the third side wall 180 and the bottom locking flap 427.

The top locking flap 315 includes locking tabs 330, 335, 340 that are located on the top edge of the top locking flap 315, and cut-outs 320, 325 that are located between the locking tabs 330, 335, 340. The bottom wall 185 includes locking slots 345, 350, 355 that are located at the fold line 420 and can engage with the locking tabs 330, 335, 340, respectively, to erect the tray 160. The first side wall 170 and the bottom wall 185 include cut-outs 215, 220 that are located at fold line 420 and are placed between the locking slots 345, 350, 355. The bottom locking flap 427 includes locking tabs 455, 460, 465 located on the bottom edge of the bottom locking flap 427. The bottom wall 185 includes locking slots 470, 475, 480 that are located at the bottom edge of the third side wall 180 and can engage with the locking tabs 455, 460, 465, respectively, to erect the tray 160.

All of the fold lines formed in blank 400 are formed by crushing the paperboard along the line to be folded to facilitate bending of the paperboard to form the various panels and flaps. All perforations in the paperboard blank of this disclosure preferably are formed by scoring the paperboard so it is cut about 50% into the outer side of the paperboard material. This 50% cut is a continuous cut that extends from the surface of the material down to a depth that is about half of the thickness of the material. The 50% cut assures a clean tear at the surface that leaves a relatively pleasing appearance, particularly when the paperboard blank is printed.

To assemble the tray 160, the blank 400 is first folded by bending the paperboard along the vertical fold lines 405, 410. This allows the second side wall 175 and fourth side wall 165 to be folded 90 degrees such that the second side wall 175 and fourth side wall 165 are generally perpendicular to the bottom wall 185, and the second side wall 175 and fourth side wall 165 extend in the same direction.

The blank 400 can be folded along horizontal fold lines 415, 430, 435, 450 such that the end flaps 305, 310, 485, 490 are generally perpendicular to the second and fourth side walls 175, 165 and extend towards the second and fourth side walls 175, 165, respectively. The blank 400 can be folded along horizontal lines 420, 440 such that the first and third side walls 170, 180 are generally perpendicular to the bottom wall 185. The casters 117, 119 are placed at cut-outs 215, 220. The top and bottom locking flaps 315, 427 are folded along horizontal lines 425, 445 such that the locking tabs 330, 335, 340, 455, 460, 465 engage with the locking slots 345, 350, 355, 470, 475, 480, respectively.

Figure 5:
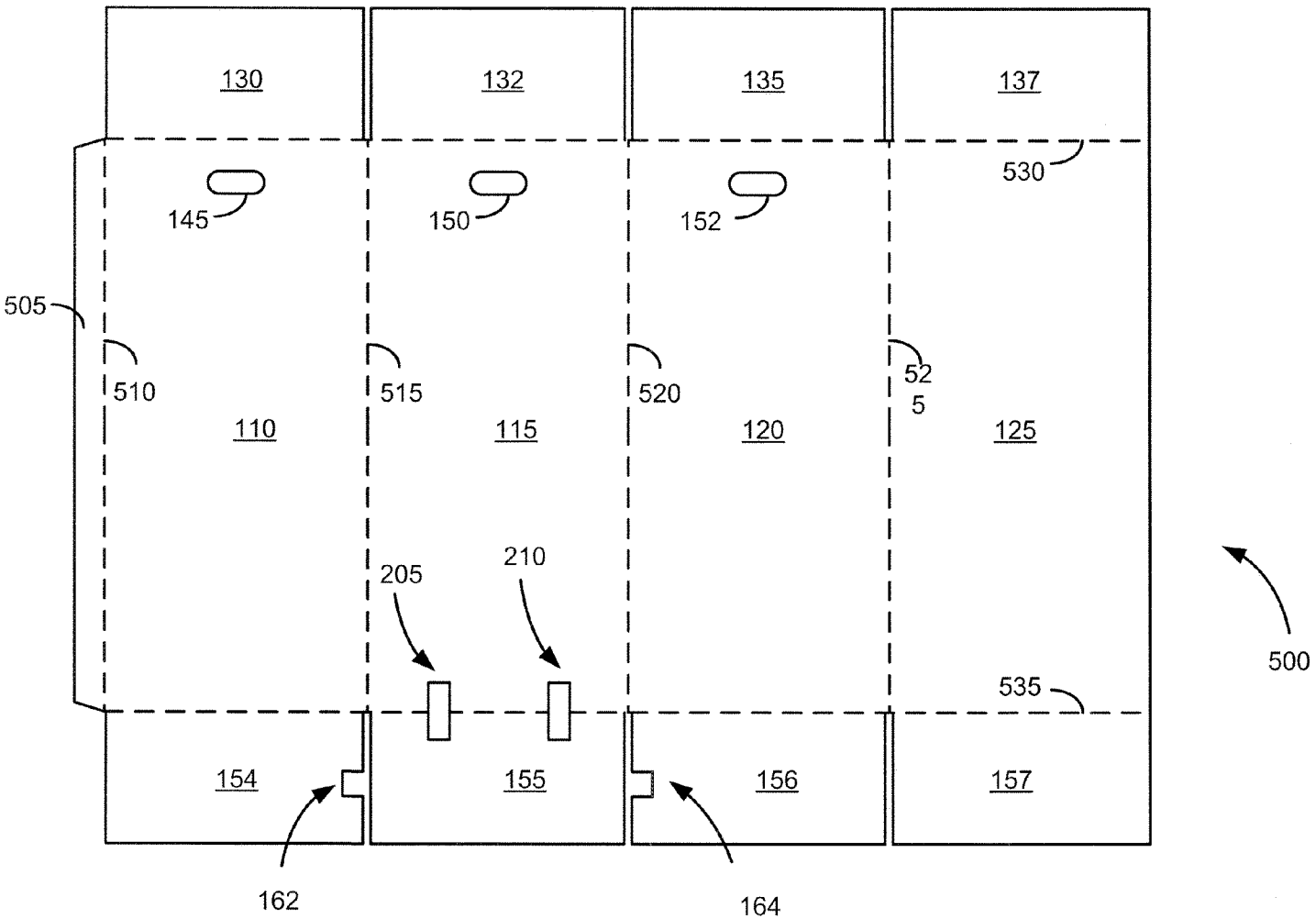
FIG. 5 is a plan view of an embodiment of a blank for erecting into a carton, such as that shown in FIG. 1.

FIG. 5 is a plan view of an embodiment of a blank 500 for erecting into the carton 105, such as that shown in FIG. 1. The blank 500 includes side flap 505 and fourth, first, second, and third side walls 110, 115, 120, 125. The side flap 505 and the fourth, first, and second side walls 110, 115, 120 are connected along their right sides to the left sides of the fourth, first, second, and third side walls 110, 115, 120, 125 along vertical fold lines 510, 515, 520, 525, respectively.

Top end flaps 130, 132, 135, 137 extend above the side walls 110, 115, 120, 125 and above fold line 530, respectively. Bottom end flaps 154, 155, 156, 157 extend below the side walls 110, 115, 120, 125 and below fold line 535, respectively. Each of the end flaps is generally rectangular in shape and has a height that is approximately half the width of the side walls 110, 115, 120, 125.

The first side wall 115 and bottom end flap 155 include cut-outs 205, 210 that are placed at the fold line 535. The bottom end flaps 154, 156 include slots 162, 164 that are placed at the left and right edges of the bottom end flaps 154, 156, respectively. The casters 117, 119 register through slots 162, 164 allowing the bottom end flaps 154, 156 to close the bottom portion of the carton 105. The fourth, first, and second side walls 110, 115, 120 includes hand holes 145, 150, 152 that are located near the top end flaps 130, 132, 135, respectively.

To assemble the carton 105, the blank 500 is first folded by bending the paperboard along the horizontal fold lines 530, 535. This allows the top end flaps 130, 132, 135, 137 and bottom end flaps 154, 155, 156, 157 to be folded 90 degrees such that the top end flaps 130, 132, 135, 137 and bottom end flaps 154, 155, 156, 157 are generally perpendicular to the side walls 110, 115, 120, 125, respectively, and the end flaps extend in the same direction.

The blank 500 can then be folded along vertical fold lines 510, 515, 520, 525 such that the fourth and second side walls 110, 120 are generally perpendicular to the side flap 505, and first and third side walls 115, 125 and extend in the same direction, respectively. The end flaps 130, 135, 154, 156 of the fourth and second side walls 110, 120 adhere to the end flaps 132, 137, 155, 157 of the first and third side walls 115, 125, respectively.

Figure 6:
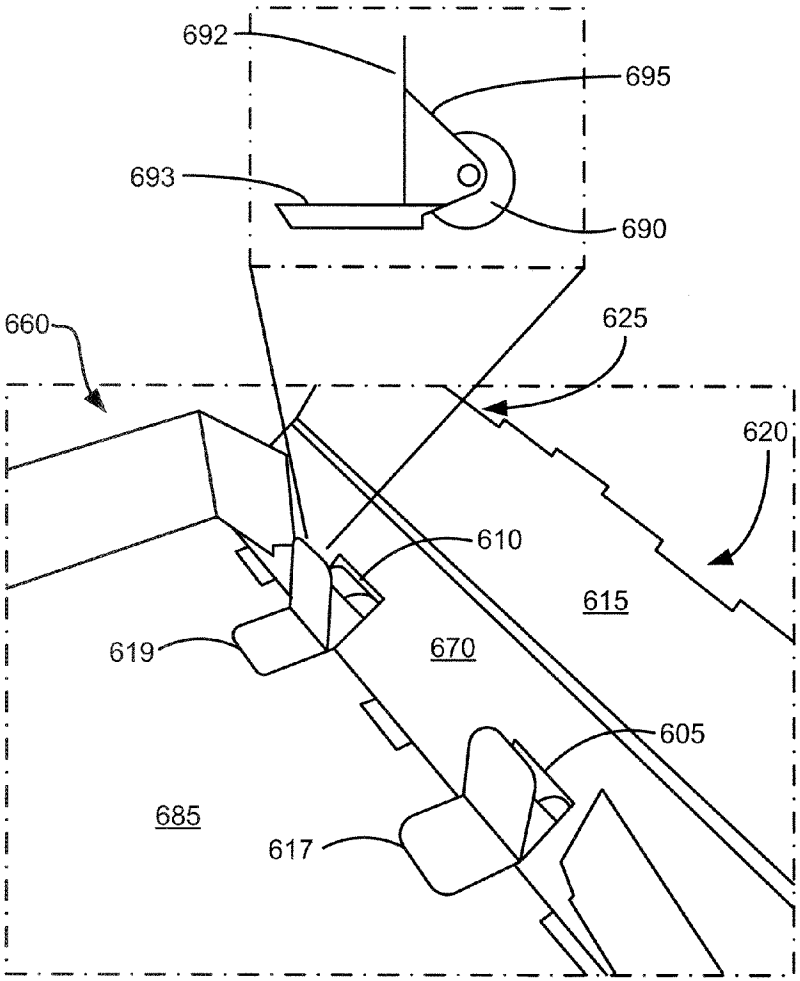
FIG. 6 is a partial top right view of an embodiment of a preassembled tray, such as that shown in FIG. 1, that includes external wheel casters.

FIG. 6 is a partial top right view of an embodiment of a preassembled tray 660, such as that shown in FIG. 1, that includes external wheel casters 617, 619. The casters 617, 619 are designed to expose substantially the entire wheel out of the packaging assembly 100. The external wheel caster 617, 619 includes a wheel housing 695 that houses a portion of the wheel 690. The apex of the wheel housing 695 includes a pin mechanism that mechanically couples the wheel housing 695 to the wheel 690. The base of the wheel housing is opposite from the apex of the wheel housing 695 and includes extensions 692, 693 that facilitate attaching the casters 617, 619 to the tray. The extensions 692, 693 and the base of the wheel housing 695 form an L-shape structure.

The design and architecture of the tray 660 are similar to the tray 160 of FIG. 1, and include side walls and a bottom wall 685. The side walls include a first side wall 670 that includes a locking flap 615. However, the locking flap 615 includes cut-outs 620, 625 that engage the extensions 693 of the external wheel casters 617, 619. The cut-outs 620, 625 facilitate capturing and maintaining the casters 617, 619 in a desired position. It should be noted that the cut-outs 320, 325 (FIG. 3) of the tray 160 have more height than the cut-outs 620, 625 of the tray 660.

Figure 7:
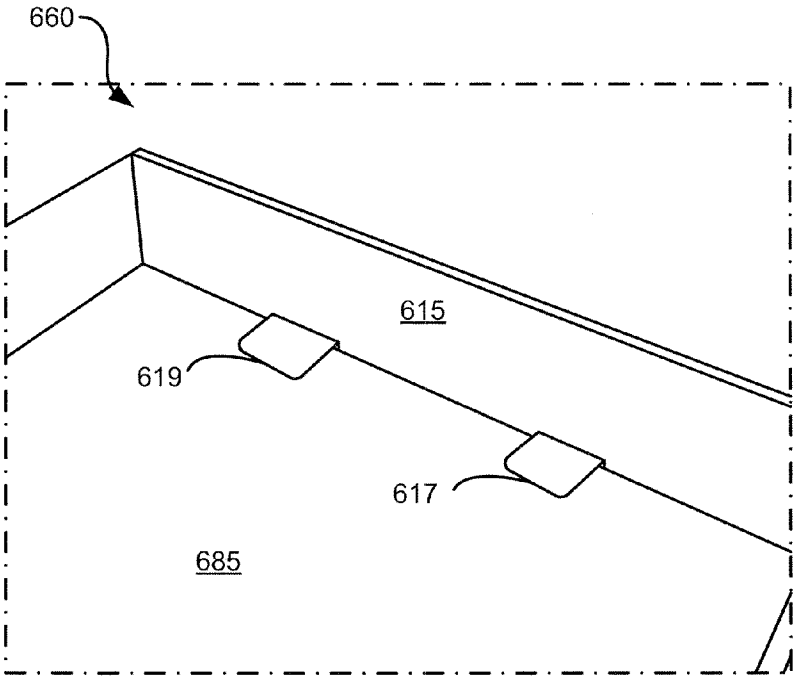
FIG. 7 is a partial top right view of an embodiment of an assembled tray, such as that shown in FIG. 6, that illustrates the external wheel casters being captured and maintained in position by the tray.

The bottom wall 685 differs from the bottom wall 185 (FIG. 4) of the tray 160 in that the bottom wall 685 does not include cut-outs for the external wheel casters 617, 619 to register therethrough. Due to the design of the external wheel casters 617, 619, the cut-outs 605, 610 on the first side wall 670 are sufficient for the external wheel casters 617, 619 to register therethrough. The bottom wall 685 along with the first side wall 670 and locking flap 615 facilitates capturing and maintaining the external wheel casters 617, 619. FIG. 7 is a partial top right view of an embodiment of an assembled tray, such as that shown in FIG. 6, that illustrates the external wheel casters 617, 619 being captured and maintained in position by the tray 660.

It should be noted that the carton 105 of FIG. 1 can be used with the tray 660. However, the carton can be modified to not include the cut-outs 205, 210, such as that shown in FIGS. 2 and 5, because the external wheel casters 617, 619 include flat extensions 693. The carton without the cut-outs 205, 210 can rest on top of the flat extensions and facilitates supporting, capturing and maintaining the casters 617, 619 in position.

Figure 8:
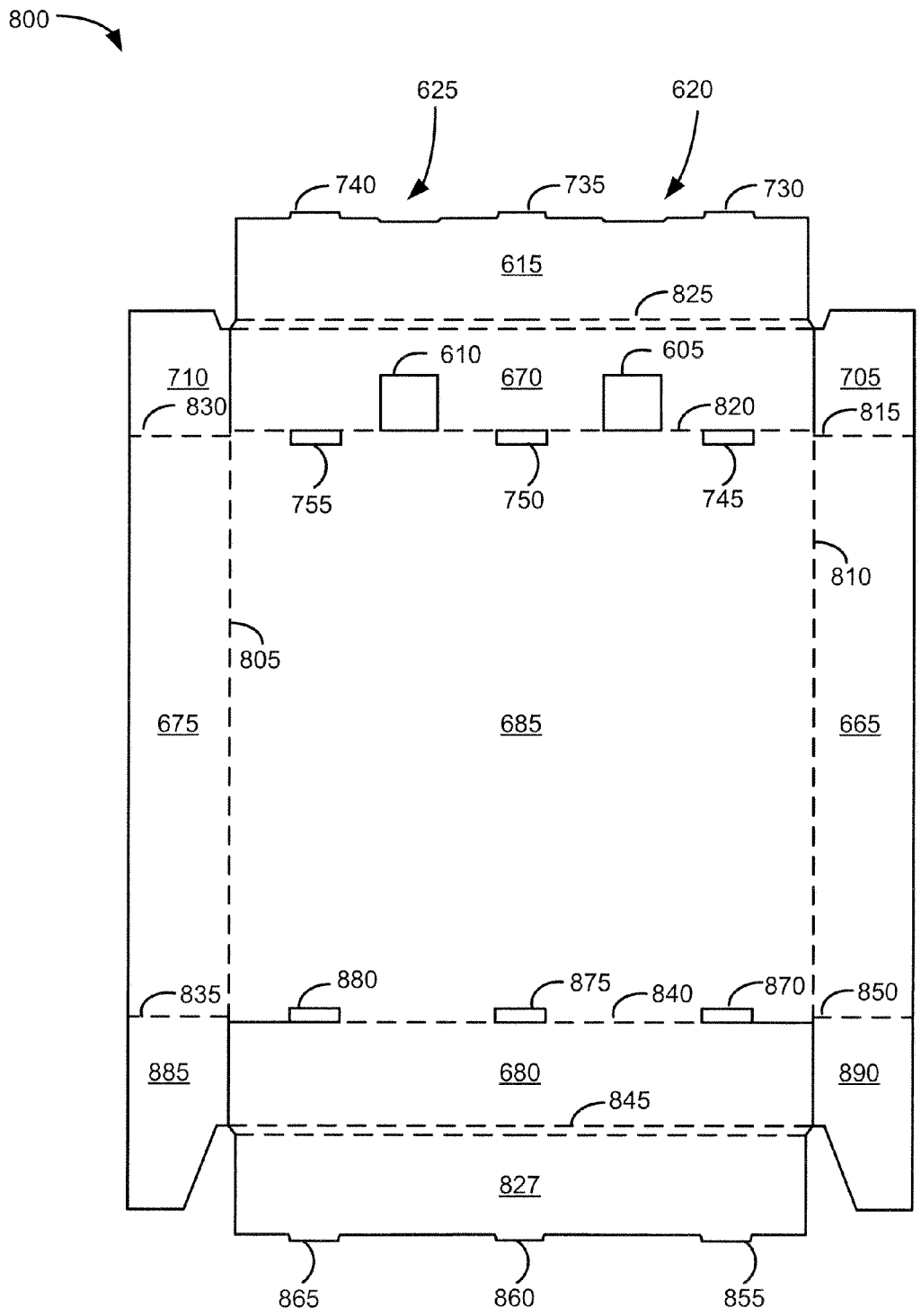
FIG. 8 is a plan view of an embodiment of a blank for erecting into a tray, such as that shown in FIG. 6.

FIG. 8 is a plan view of an embodiment of a blank 800 for erecting into a tray 660, such as that shown in FIG. 6. The blank 800 includes the bottom wall 685 and first, second, third and fourth side walls 670, 675, 680, 665, respectively. The second side wall 675 and bottom wall 685 are connected along their right sides to the left sides of the bottom wall 685 and fourth side wall 665 along first and second vertical fold lines 805, 810, respectively.

Top end flap 705, first side wall 670, top locking flap 615, and top end flap 710 extend above the fourth side wall 665, bottom wall 685, first side wall 670, and second side wall 675, and above horizontal fold lines 815, 820, 825, 830, respectively. Bottom end flap 885, third side wall 680, bottom locking flap 827, and bottom end flap 890 extend below the second side wall 675, bottom wall 685, third side wall 680, and fourth side wall 665, and below horizontal fold lines 835, 840, 845, 850, respectively. The top end flaps 705, 710 are generally in the shape of a rectangle and have a height that is approximately the height of the first side wall 670. The bottom end flaps 885, 890 are generally in the shape of a rhombus and have a height that is approximately the height of both the third side wall 680 and the bottom locking flap 827.

The top locking flap 615 includes locking tabs 730, 735, 740 that are located on the top edge of the top locking flap 615, and cut-outs 620, 625 that are located between the locking tabs 730, 735, 740. The bottom wall 685 includes locking slots 745, 750, 755 that are located at the fold line 820 and can engage with the locking tabs 730, 735, 740, respectively, to erect the tray 660. Cut-outs 605, 610 are located on the first side wall 670 adjacent to the bottom wall 685 and are placed between the locking slots 745, 750, 755. The bottom locking flap 827 includes locking tabs 855, 860, 865 that are located on the bottom edge of the bottom locking flap 827. The bottom wall 685 includes locking slots 870, 875, 880 that are located at fold line 840 and can engage with the locking tabs 855, 860, 865, respectively, to erect the tray 660.

To assemble the tray 660, the blank 800 is first folded by bending the paperboard along the vertical fold lines 805, 810. This allows the second side wall 675 and fourth side wall 665 to be folded 90 degrees such that the second side wall 675 and fourth side wall 665 are generally perpendicular to the bottom wall 685, and the second side wall 675 and fourth side wall 665 extend in the same direction. The blank 800 can be folded along horizontal fold lines 815, 830, 835, 850 such that the end flaps 705, 710, 885, 890 are generally perpendicular to the second and fourth side walls 675, 665 and extend in the same direction, respectively.

The blank 800 can be folded along horizontal lines 820, 840 such that the first and third side walls 670, 680 are generally perpendicular to the bottom wall 685 and extend in the same direction as second and fourth side walls 675, 665. The casters 617, 619 are placed at cut-outs 605, 610, respectively. The top and bottom locking flaps 615, 827 are folded along horizontal lines 825, 845 such that the locking tabs 730, 735, 740, 855, 860, 865 engage with the locking slots 745, 750, 755, 870, 875, 880, respectively.

Figure 9:
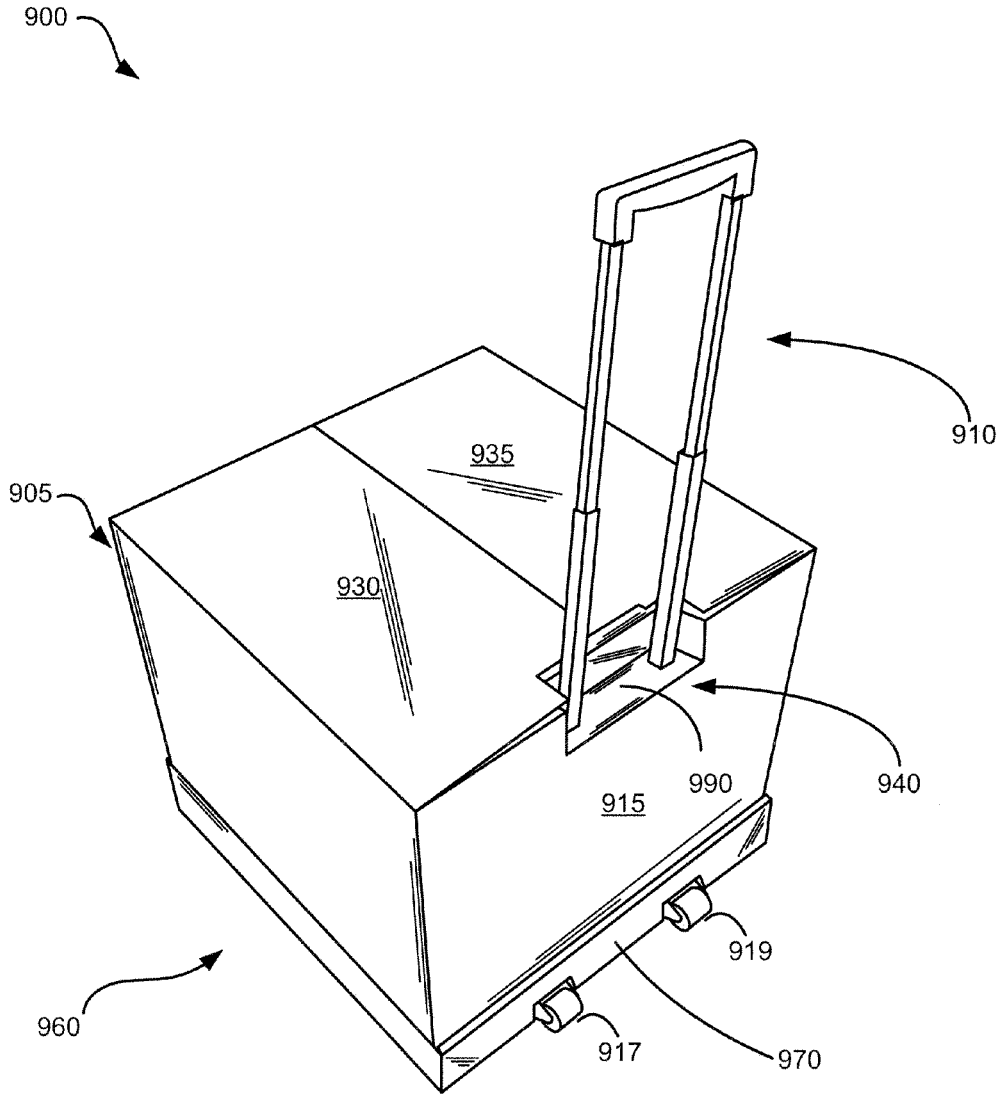
FIG. 9 is a perspective view of an embodiment of another package assembly, such as that shown in FIG. 1, that includes a telescoping handle.

FIG. 9 is a perspective view of an embodiment of another package assembly, such as that shown in FIG. 1, and is denoted generally by reference number 900. The package assembly 900 includes a carton 905 having a telescoping handle 910. The carton 905 has a cut-out 940 at the edge between the top panels 930, 935 and a first side wall 915 of the carton 905. The telescoping handle 910 is captured and maintained by a handle insert 990. The telescoping handle 910 slides upward through the cut-out 940 parallel to the plane of the first side wall 915 of the carton 905. The carton 905 is placed on top of a tray 960, such as that shown in FIGS. 1 and/or 6, having casters 917, 919. The carton 905 and handle insert 990 are described in relation to FIGS. 10-12.

Figure 10:
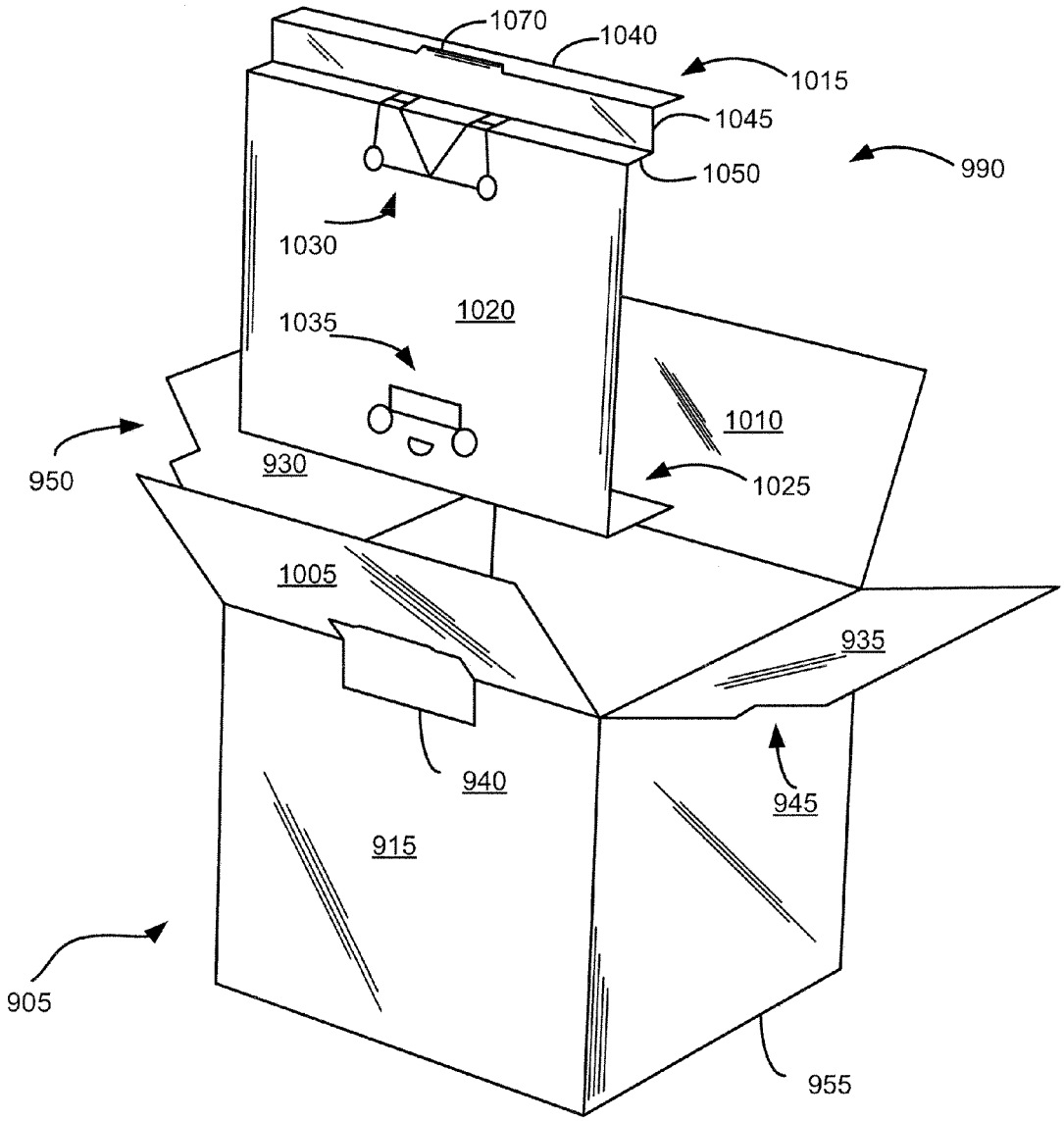
FIG. 10 is a perspective view of an embodiment of a preassembled carton, such as that shown in FIG. 9, that includes a handle insert that facilitates attaching the telescoping handle to the carton.

FIG. 10 is a perspective view of an embodiment of a pre-assembled carton 905, such as that shown in FIG. 9, that includes the handle insert 990 that facilitates attaching the telescoping handle 910 to the carton 905. The carton 905 includes top panels 930, 935, 1005, 1010 that have a height approximately half the width of a side wall 915 of the carton 905. The second and third top panels 930, 935 include cut-outs 945, 950 located on a top right corner and top left corner of the second and third top panels 930, 935, respectively. The corner cut-outs 945, 950 align with a portion of the cut-out 940 of the top panel 1005.

The handle insert 990 include a top panel 1015, middle panel 1020, and bottom panel 1025 that have a width that is approximately the width of the first side wall 915. The bottom panel 1025 and the top panel 1015 are foldably attached to the middle panel 1020. The top, middle and bottom panels 1015, 1020, 1025 extend parallel to the plane of the top panels 930, 935, 1005, 1010 (when closed), first side wall 915, and bottom wall 955 of the carton 905, respectively.

The middle panel 1020 includes upper and lower locking mechanisms 1030, 1035 that facilitate capturing and maintaining the telescoping handle in a desired position. The top panel 1015 includes an upper horizontal panel 1040, vertical panel 1045 and lower horizontal panel 1050. The upper and lower horizontal panels 1040, 1050 extend perpendicular to the vertical panel 1045 and parallel to the plane of the bottom wall of the carton 905. The vertical panel 1045 extend perpendicular to the upper and lower horizontal panels 1040, 1050 and parallel to the plane of the first side wall 915. The vertical panel 1045 includes a tab 1070 that engages with cut-out 940 of the top panel 1005 to facilitate securing the handle insert 990 in the carton 90. The insert handle 990 is further described in relation to FIG. 11.

Figure 11:
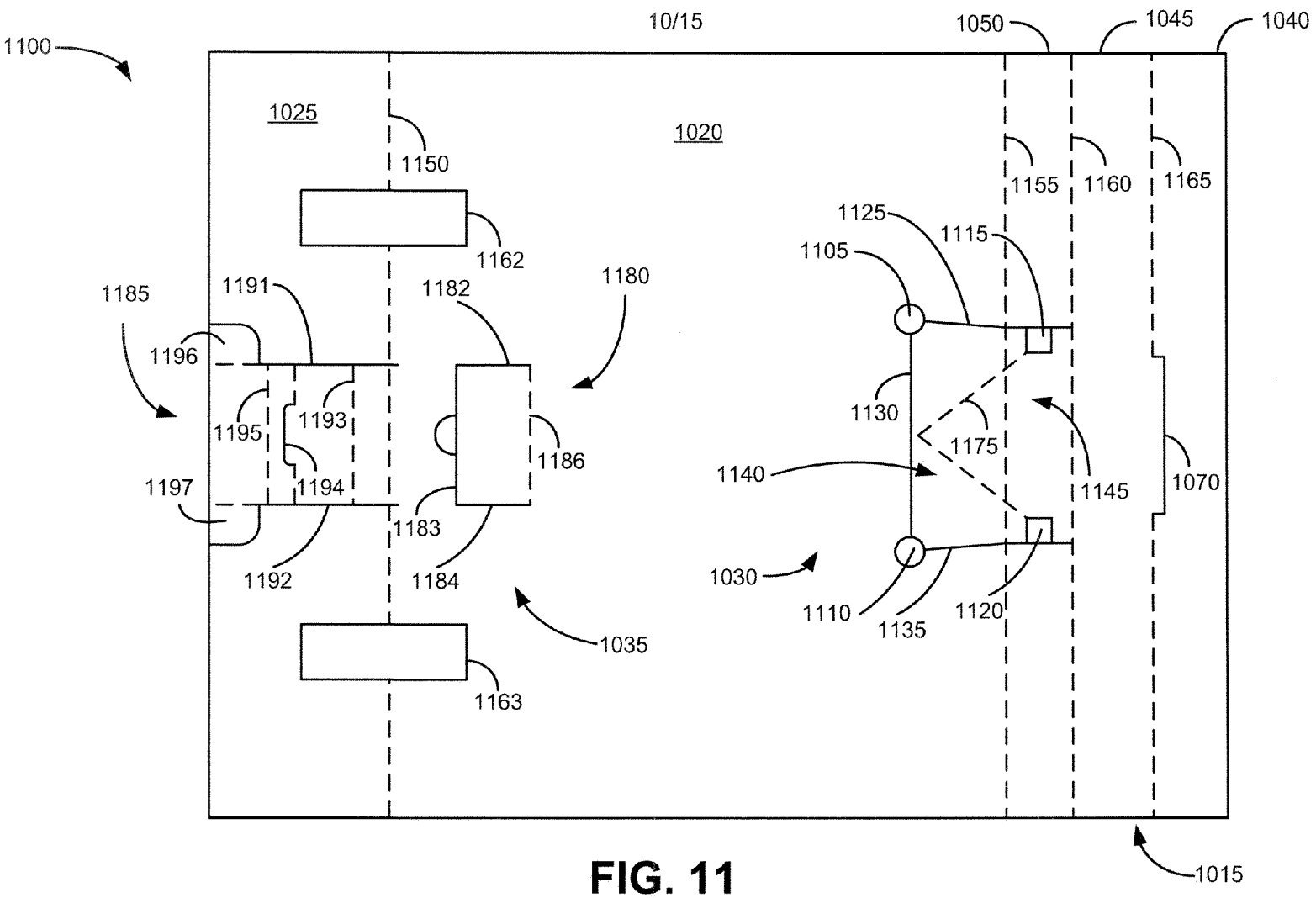
FIG. 11 is a plan view of an embodiment of a blank for erecting into a handle insert, such as that shown in FIG. 10.

FIG. 11 is a plan view of an embodiment of a blank 1100 for erecting into a handle insert 990, such as that shown in FIG. 10. The blank 1100 includes left panel 1025, middle panel 1020, and right panel 1015. The left panel 1025 and the middle panel 1020 are connected along their right sides to the left sides of the middle panel 1020 and right panel 1015 along vertical fold lines 1150, 1155, respectively. The right panel 1015 includes lower horizontal panel 1050, vertical panel 1045 and upper horizontal panel 1040. The lower horizontal panel 1050 and vertical panel 1045 are connected along their right sides to the left sides of the vertical panel 1045 and upper horizontal panel 1040 along vertical fold lines 1160, 1165, respectively.

The upper horizontal panel 1040 includes a cut-line that forms a tab 1070 that can engage the cut-out 940 of the top panel 1005 (FIG. 10). A portion of the right panel 1015 and the middle panel 1020 includes the upper locking mechanism 1030, which has a substantially rectangular shape and is formed by cut-lines 1125, 1130, 1135 and vertical fold line 1160. The upper locking mechanism 1030 has a vertical portion 1140 that is located on the middle panel 1020 and a horizontal portion 1150 that is located on the lower horizontal panel 1050. The vertical portion 1140 is formed by cut-lines 1125, 1130, 1135 and vertical fold line 1155, and the horizontal portion 1145 is formed by cut-lines 1125, 1135 and vertical fold lines 1155, 1160. The horizontal portion 1150 includes holes 1115, 1120 at the cut-lines 1125, 1135, respectively. The vertical portion 1140 of the upper locking mechanism 1030 includes holes 1105, 1110 that are located at the corner of the cut-lines 1125, 1130, 1135, respectively. The upper locking mechanism 1030 further includes a V-shape fold line 1175.

The blank 1100 further includes a lower locking mechanism 1035 that includes a female member 1180 and a male member 1185. Both the female and male members 1180, 1185 has a substantially rectangular shape. The female member 1180 is formed by cut-lines 1182, 1183, 1184 and fold line 1186. The male member 1185 is form by horizontal cut-lines 1191, 1192, vertical fold line 1150 and the left edge of the left panel 1025. The male member 1185 includes vertical fold lines 1193, 1194, 1195 that are located between the cut-lines 1191, 1192.

The vertical fold line 1194 further includes a cut-line in the middle of the fold line 1194 that forms a tab. The vertical fold lines 1193, 1194, 1195 facilitates attaching the telescoping handle to the handle insert 905. The male member 1185 further includes top and bottom flaps 1196, 1197 that engage with the female member 1180 to facilitate capturing and maintaining the lower portion of the telescoping handle 910. Alternatively or additionally, the handle insert 905 can include cut-outs 1162, 1163 that the recessed wheel casters 917, 919 can register therethrough.

To assemble the handle insert 905, the blank 1100 is first folded by bending the paperboard along vertical fold lines 1150, 1155. This allows the left panel 1025 and right panel 1015 to be folded 90 degrees such that the left panel 1025 and right panel 1015 are generally perpendicular to the middle panel 1020, and the left panel 1025 and right panel 1015 extend in the same direction. The lower and upper locking mechanisms 1035, 1030 are partially displaced off the panels 1025, 1020, 1015 at cut-lines 1182, 1183, 1184, 1191, 1192, 1125, 1130, 1135, respectively.

The upper portion 1039 (FIGS. 11A-B) of the telescoping handle 910 is placed through the upper locking mechanism 1030 and engages the holes 1115, 1120 of the upper locking mechanism 1030. The V-shape fold line 1175 can be folded to aid in placing the handle 910 through the upper locking mechanism 1030. The male member 1185 of the lower locking mechanism 1035 can be folded at vertical fold lines 1193, 1194, 1195 allowing the male member 1185 to wrap around the lower portion 1036 (FIGS. 11A-B) of the telescoping handle 910. The flaps 1196, 1197 of the male member 1185 engages the female member 1180 by penetrating through the cut-lines 1182, 1183. The female member 1180 can be closed to lock the flaps 1196, 1197 in position.

Figure 11B:
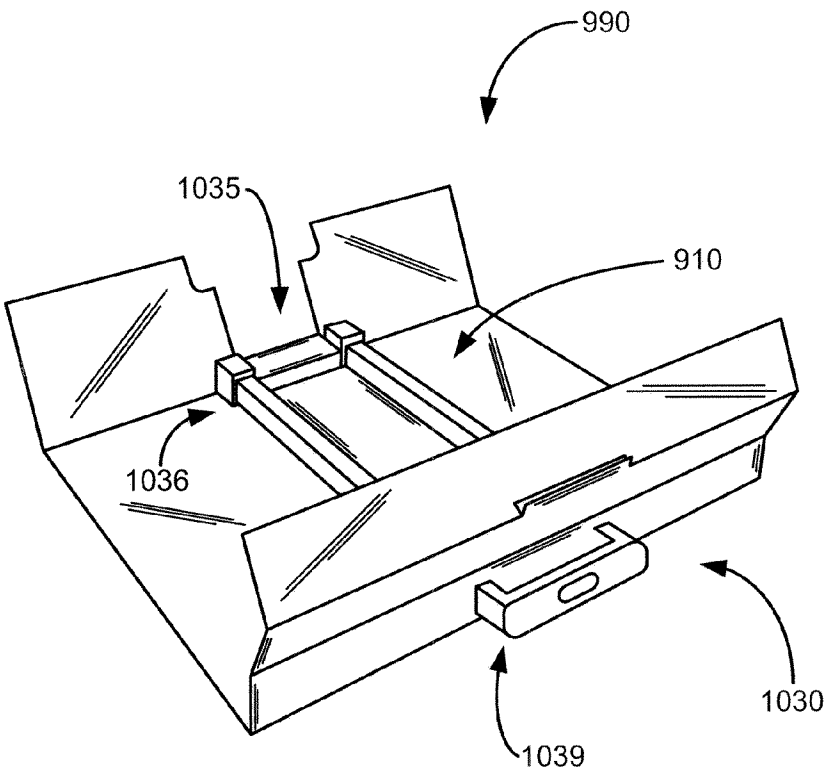
FIGS. 11A-B illustrate a handle insert that is attached with a telescoping handle.
Figure 11A:
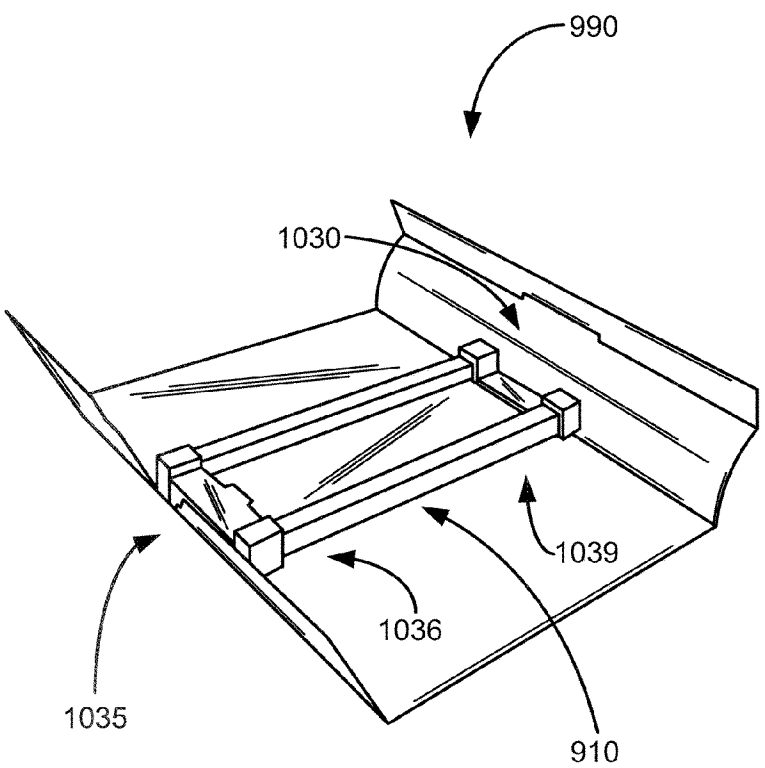

The vertical panel 1045 of the right panel 1015 is then folded 90 degrees away from the middle panel 1020 such that vertical panel 1045 are parallel to the plane of the middle panel 1020. The upper horizontal panel 1040 is then folded 90 degrees such that upper horizontal panel 1040 extends in the same direction as the left panel 1025 of the handle insert 905 and are generally perpendicular to the middle panel 1020. FIGS. 11A-B illustrate a handle insert 905 that is attached with a telescoping handle 910.

Figure 12:
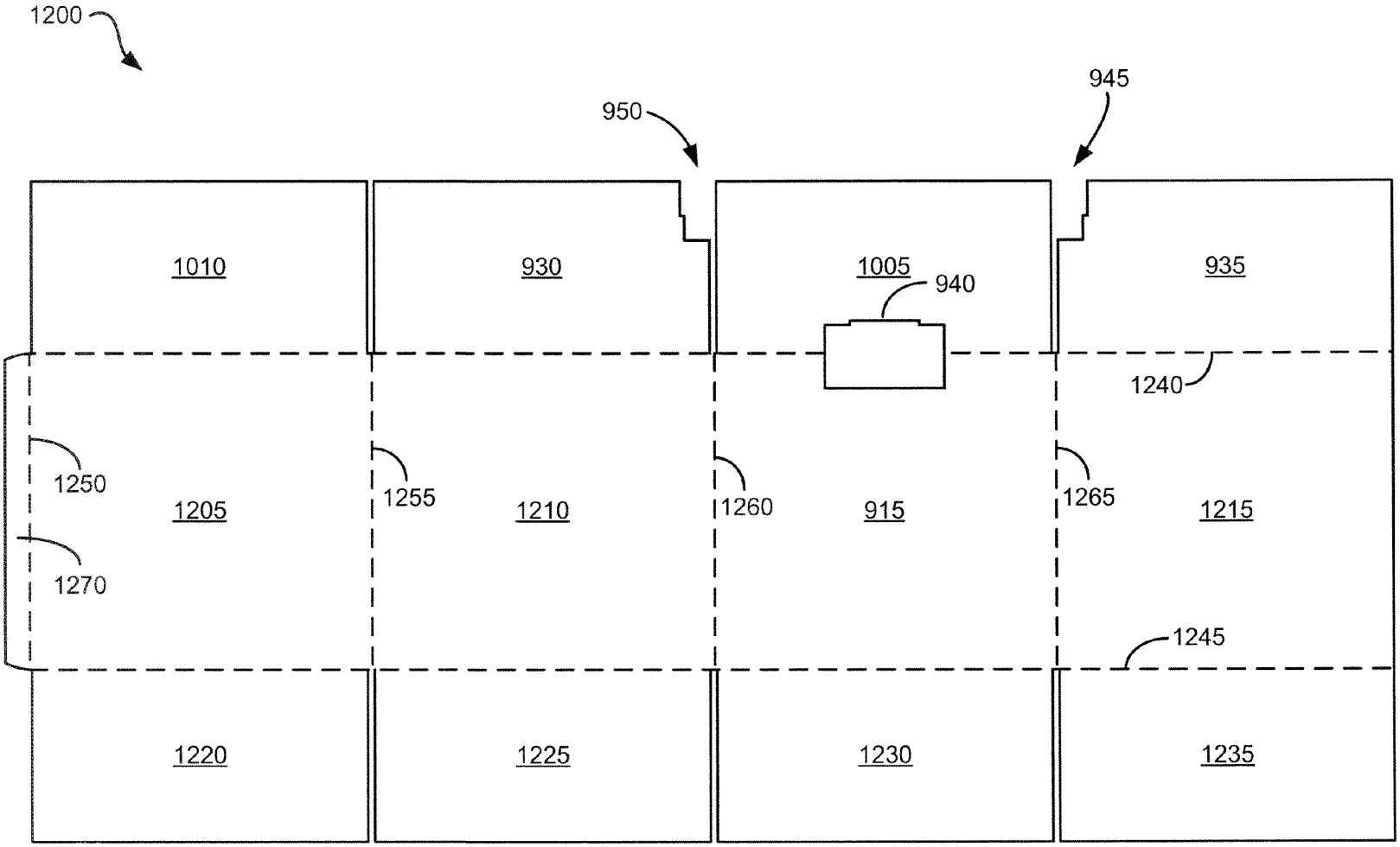
FIG. 12 is a plan view of an embodiment of a blank for erecting into a carton, such as that shown in FIG. 10.

FIG. 12 is a plan view of an embodiment of a blank 1200 for erecting into a carton 905, such as that shown in FIG. 10. The blank 1200 includes side flap 1270, and fourth, third, first, and second side wall 1205, 1210, 915, 1215. The side flap 1270, and fourth, third and first side wall 1205, 1210, 915 are connected along their right sides to the left sides of the fourth, third, first, and second side wall 1205, 1210, 915, 1215 along vertical fold lines 1250, 1255, 1260, 1265, respectively.

Top end panels 1010, 930, 1005, 935 extend above the side walls 1205, 1210, 915, 1215 and above fold line 1240, respectively. Bottom end panels 1220, 1225, 1230, 1235 extend below the side walls 1205, 1210, 915, 1215 and below fold line 1245, respectively. Each of the end panels is generally rectangular in shape and has a height that is approximately half the width of the side walls 1205, 1210, 915, 1215. First side wall 915 and top end panel 1005 includes a cut-out 940 that is placed at the fold line 1240. The top end panels 930, 935 include cut-outs 950, 945 located on a top right corner and top left corner of the top panels 930, 935, respectively.

To assemble the carton 905, the blank 1200 is first folded by bending the paperboard along the horizontal fold lines 1240, 1245. This allows the top end panels 1010, 930, 1005, 935 and bottom end panels 1220, 1225, 1230, 1235 to be folded 90 degrees such that the top end panels 1010, 930, 1005, 935 and bottom end panels 1220, 1225, 1230, 1235 are generally perpendicular to the side walls 1205, 1210, 915, 1215, respectively, and the end flaps extend in the same direction.

The blank 1200 can then be folded along vertical fold lines 1250, 1255, 1260, 1265 such that the fourth and first side walls 1205, 915 are generally perpendicular to the side flap 1270, and third and second side walls 1210, 1215 and extend in the same direction, respectively. The end panels 1010, 1220, 1005, 1230 of the fourth and first side wall 1205, 915 adhere to the end panels 930, 1225, 935, 1235, respectively.

Figure 13:
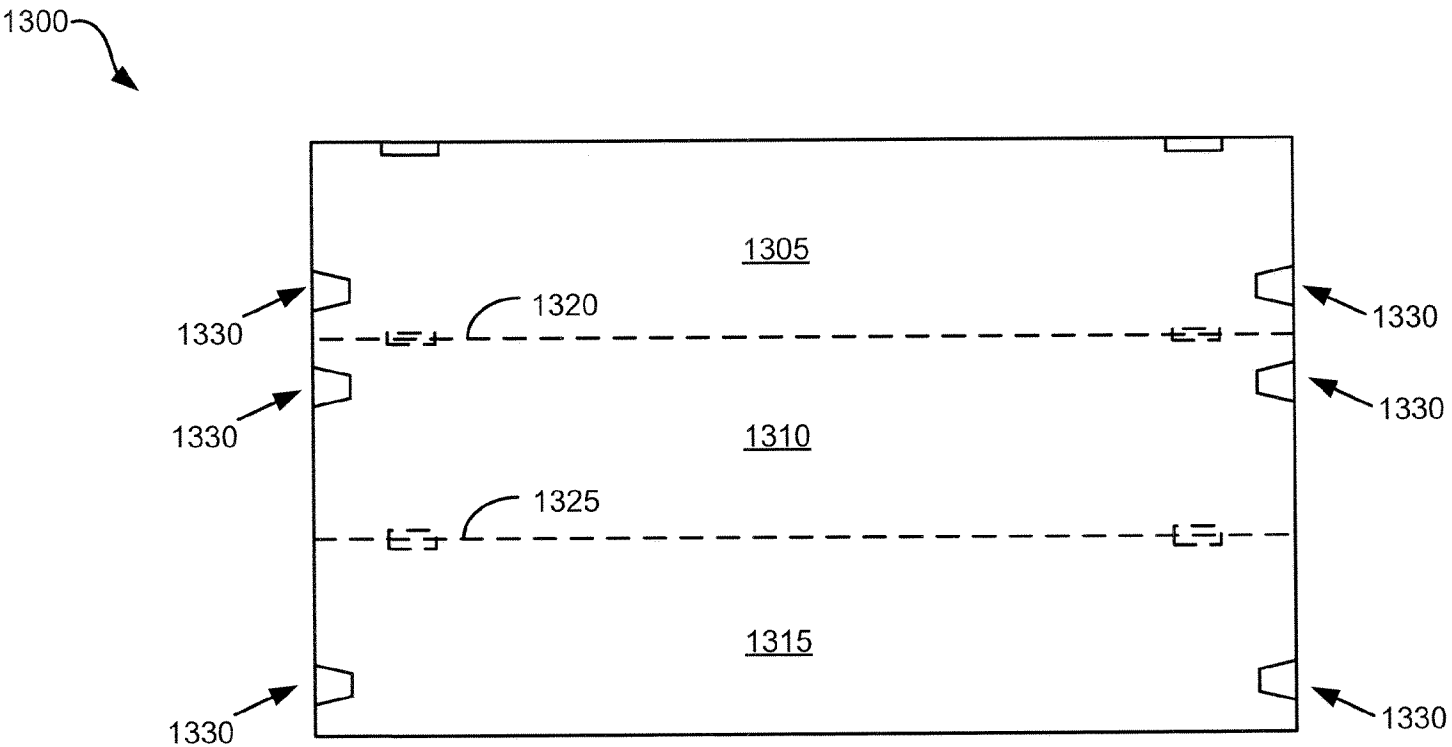
FIG. 13 is a plan view of an embodiment of a blank for erecting into a leveling piece that is placed under a tray, such as that shown in FIG. 9, to level the tray.

FIG. 13 is a plan view of an embodiment of a blank 1300 for erecting into a leveling piece that is placed under a tray 160, such as that shown in FIG. 1, to level the tray 160 having casters 117, 119 (FIG. 1). The blank 1300 includes a first panel 1305, second panel 1310, and third panel 1315. The first panel 1305 and second panel 1310 are connected along their bottom sides to the top sides of the second panel 1310 and third panel 1315 along horizontal fold lines 1320, 1325. Each of the panels 1305, 1310, 1315 includes locking tabs 1330 on the left and right side edges of the panels 1305, 1310, 1315.

To assemble the leveling piece, the blank 1300 is first folded by bending the first panel 1305 along the horizontal fold line 1320 to abut the second panel 1310. The third panel 1315 is folded along horizontal fold line 1325 over the first and second panels 1305, 1310. The locking tabs 1330 are pushed down to secure the panels 1305, 1310, 1315 together.

Figure 14:
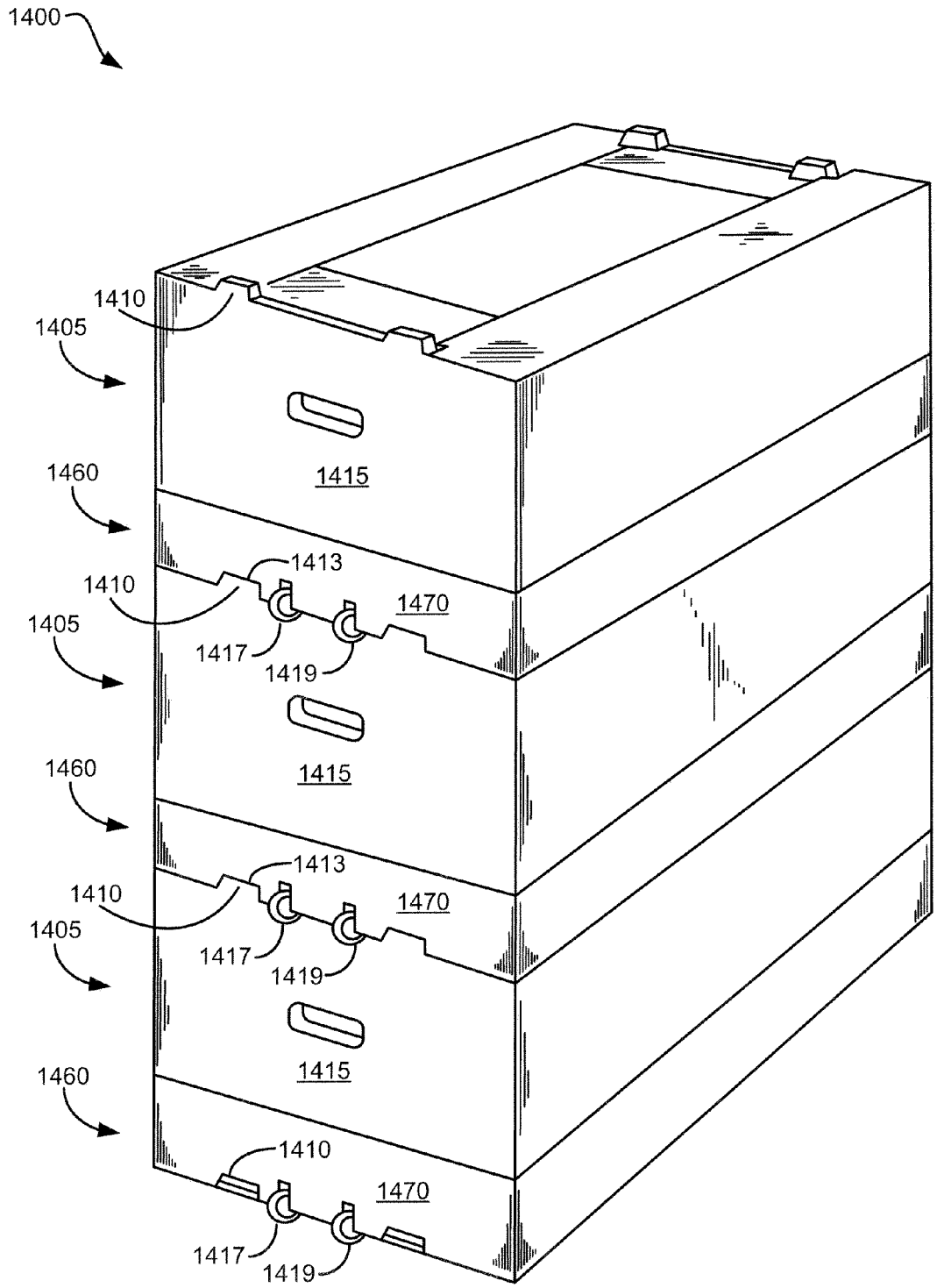
FIG. 14 is a perspective view of an embodiment of multiple package assemblies, such as that shown in FIG. 1, that are stacked on top of each other.

FIG. 14 is a perspective view of an embodiment of multiple package assemblies 1400, such as that shown in FIG. 1, that are stacked on top of each other. Each package assembly includes a carton 1405 that includes stacking tabs 1410 that are located on the top edge of a side wall 1415 of the carton 1405, and a tray 1460 that includes casters 1417, 1419 and stacking slots 1410, both located on the bottom edge of a side wall 1470 of the tray 1460. The package assembly can be placed on top of each other such that the stacking slots 1410 receive the stacking tabs 1413.

Figure 16:
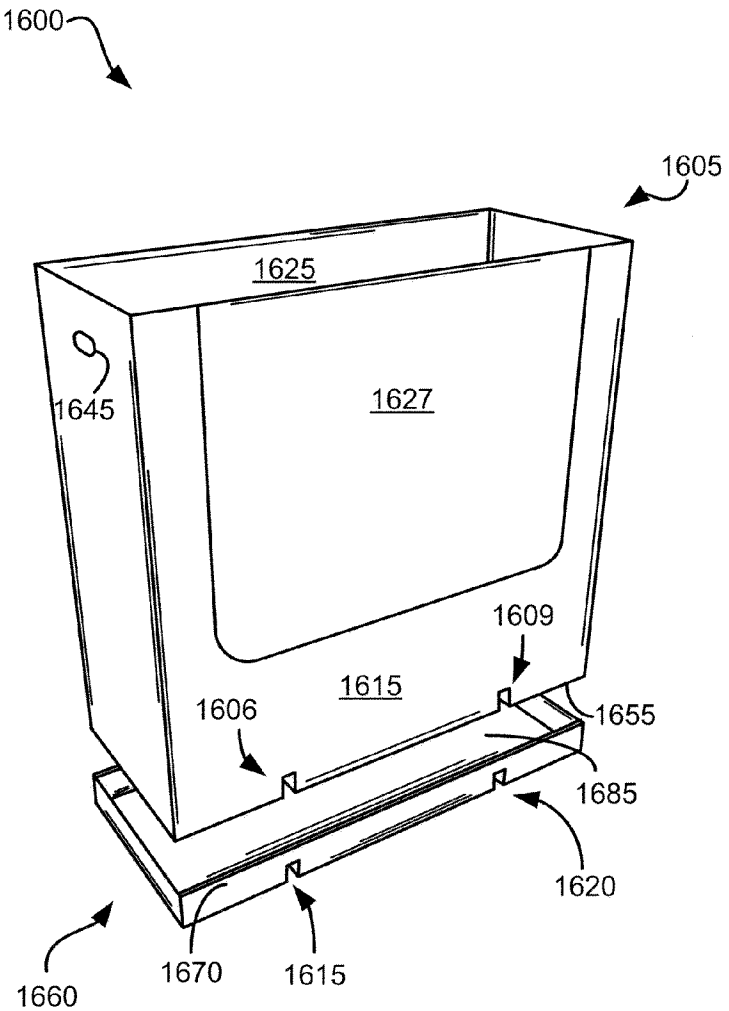
FIGS. 15 and 16 are perspective views of other embodiments of preassembled packaging assemblies of the invention.
Figure 15:
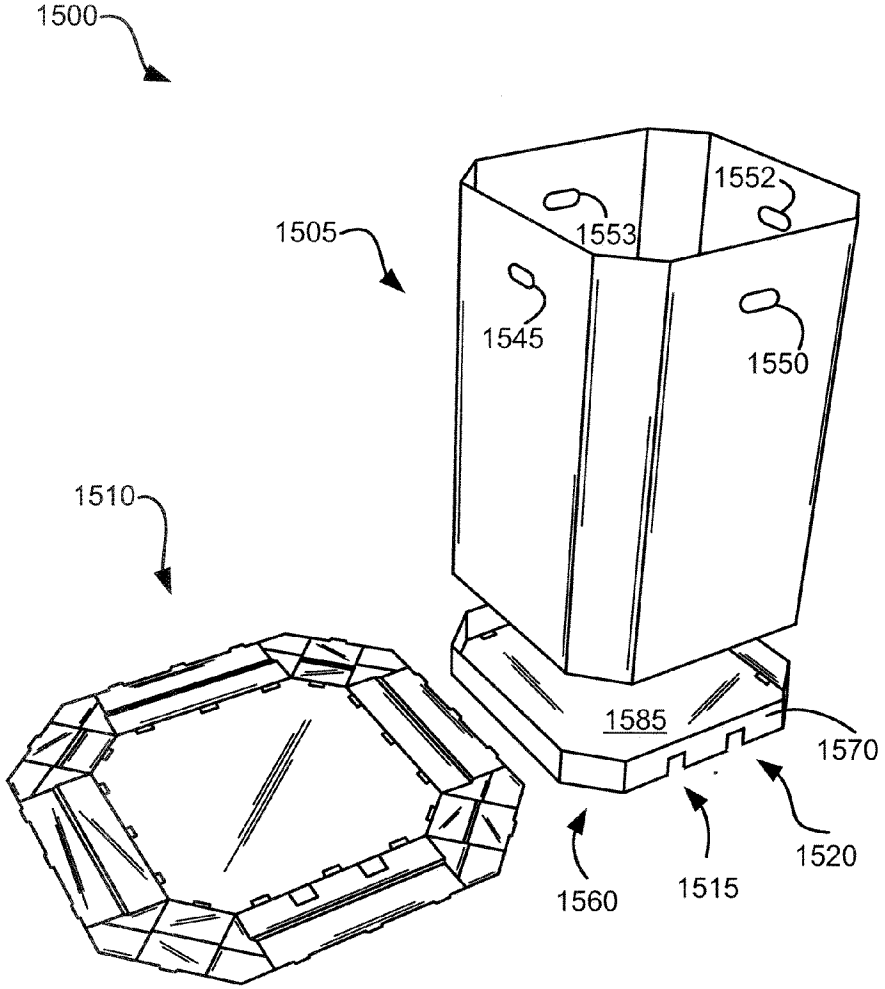

FIGS. 15 and 16 are perspective views of other embodiments of preassembled packaging assemblies, such as that shown in FIG. 1. In FIG. 15, the package assembly 1500 has a cross-sectional shape of an octagon and includes carton 1505, tray 1560, and lid 1510. The carton 1505 includes hand holes 1545, 1550, 1552, 1553 on respective side walls that a user can use to tilt the carton 1505 on casters (not shown) and move the carton 1505. The edge between the first side wall 1570 and bottom wall 1585 of the tray 1560 includes cut-outs 1515, 1520 that the wheel casters register therethrough.

In FIG. 16, the packaging assembly 1600 has a cross-sectional shape of a rectangle and includes a display carton 1605 and a tray 1660. The display carton 1605 includes a window panel 1627 that can be displaced off the carton 1605. The window panel 1627 is placed on the upper portion of a first side wall 1615. The edges between the first side walls 1615, 1670 and bottom walls 1655, 1685 of the carton 1605 and tray 1660, respectively, include cut-outs 1606, 1609, 1615, 1620 that the wheel casters (not shown) register therethrough.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

The invention claimed is:

1. A packaging assembly for moving a product in a carton comprising:
   a carton that is designed to contain the product; and
   a tray that is placed below the carton,
   the tray having at least one caster that facilitates moving the carton,
   the at least one caster including an extension;
   wherein the tray includes a bottom wall and at least one side wall that includes a first side wall, the first side wall being foldably attached to a locking flap and the extension at least partially positioned therebetween;
   wherein the locking flap is substantially parallel to the first side wall; and
   wherein the bottom wall includes at least one slot located adjacent to the edge between the first side wall and the bottom wall, the locking flap further including at least one locking tab that engages with the at least one slot of the bottom wall and facilitates locking the locking flap to secure the at least one caster between the locking flap and the first side wall and between the locking flap and the bottom wall.

2. The packaging assembly as defined in claim 1, wherein the carton includes at least one hand hole.

3. The packaging assembly as defined in claim 1, wherein the caster includes an external wheel caster that exposes substantially the entire wheel out of the packaging assembly, the first side wall including at least one cut-out that is adjacent to the bottom wall, the external wheel caster registered through the at least one cut-out of the first side wall.

4. The packaging assembly as defined in claim 1, further comprising a telescoping handle and a handle insert that facilitates attaching the telescoping handle to the carton, the handle insert and the telescoping handle being placed inside the carton and adjacent to at least one side wall of the carton.

5. The packaging assembly as defined in claim 1, further comprising at least one leveling piece that is placed under the tray opposite from the at least one caster to level the tray that rests on the at least one caster.

6. The packaging assembly as defined in claim 1, wherein the carton has at least one stacking tab that is placed on a top edge of at least one side wall of the carton, the tray having at least one stacking recess that is placed on the bottom edge of at least one side wall of the tray, the stacking tab and stacking recess being designed to facilitate stacking the packaging assembly on top and/or at the bottom of another packaging assembly.

7. The packaging assembly as defined in claim 1, wherein the carton is attached to the tray using an adhesive bond.

8. The packaging assembly as defined in claim 1, wherein the first side wall includes at least one cut-out that is adjacent to the bottom wall and wherein the at least one caster registers through the at least one cut-out of the first side wall.

9. A packaging assembly for moving a product in a carton comprising:
   a carton that is designed to contain the product; and
   a tray that is placed below the carton,
   the tray having at least one caster that facilitates moving the carton, the at least one caster including an extension;

wherein the tray includes a bottom wall and at least one side wall that includes a first side wall, the first side wall being foldably attached to a locking flap and the extension at least partially positioned therebetween;

wherein the locking flap is substantially parallel to the first side wall;

wherein the bottom wall includes at least one slot located adjacent to the edge between the first side wall and the bottom wall, the locking flap further including at least one locking tab that engages with the at least one slot of the bottom wall and facilitates locking the locking flap to secure the at least one caster between the locking flap and the first side wall and between the locking flap and the bottom wall; and wherein the at least one caster includes a recessed wheel caster that is designed to conceal at least a portion of the wheel within the packaging assembly, the carton including a bottom wall and a first side wall, the edges between the first side walls and the bottom walls of the tray and the carton each including at least one cut-out and the recessed wheel caster registered through the at least one cut-out.

10. A package comprising:

a product;

a carton that is designed to contain the product; and a tray that is placed below the carton, the tray having at least one caster that facilitates moving the carton, the at least one caster including an extension, the tray including a bottom wall and at least one side wall that includes a first side wall, the first side wall being foldably attached to a locking flap and the extension at least partially positioned therebetween;

wherein the locking flap is substantially parallel to the first side wall; and wherein the bottom wall includes at least one slot located adjacent to the edge between the first side wall and the bottom wall, the locking flap further including at least one locking tab that engages with the at least one slot of the bottom wall and facilitates locking the locking flap to secure the at least one caster between the locking flap and the first side wall and between the locking flap and the bottom wall.

11. The package as defined in claim 10, wherein the carton includes at least one hand hole.

12. The package as defined in claim 10, wherein the at least one caster includes a recessed wheel caster that exposes a portion of the wheel out of the package, the edge between the first side wall and the bottom wall including at least one cut-out and the recessed wheel caster registered through the at least one cut-out.

13. The package as defined in claim 10, wherein the at least one caster includes an external wheel caster that exposes substantially the entire wheel out of the package, the first side wall including at least one cut-out that is adjacent to the bottom wall, the external wheel caster registered through the at least one cut-out of the first side wall.

14. The package as defined in claim 10, further comprising a telescoping handle and a handle insert that facilitates attaching the telescoping handle to the carton, the handle insert and the telescoping handle being placed inside the carton and adjacent to at least one side wall of the carton.

15. The package as defined in claim 10, further comprising at least one leveling piece that is placed under the tray opposite from the at least one caster to level the tray that rests on both the at least one caster and the at least one leveling piece.

16. The package as defined in claim 10, wherein the carton has at least one stacking tab that is placed on a top edge of at least one side wall of the carton, the tray having at least one stacking recess that is placed on the bottom edge of at least one side wall of the tray, the stacking tab and stacking recess being designed to facilitate stacking the packaging assembly on top and/or at the bottom of another packaging assembly.

17. The package as defined in claim 10, wherein the first side wall includes at least one cut-out that is adjacent to the bottom wall and wherein the at least one caster registers through the at least one cut-out of the first side wall.

* * * * *